US007654789B2

(12) United States Patent
Meier

(10) Patent No.: US 7,654,789 B2
(45) Date of Patent: Feb. 2, 2010

(54) APPARATUS FOR FORMING STACKS WITH PRINT PRODUCTS WITH EJECTION GROOVE AND LIFTING PLATES

(75) Inventor: Hans Meier, Büron (CH)

(73) Assignee: Mueller Martini Holding AG, Hergiswil (CH)

( * ) Notice: Subject to any disclaimer, the term of this patent is extended or adjusted under 35 U.S.C. 154(b) by 0 days.

(21) Appl. No.: 11/121,126

(22) Filed: May 4, 2005

(65) Prior Publication Data

US 2005/0281655 A1 Dec. 22, 2005

(30) Foreign Application Priority Data

May 5, 2004 (EP) ..... 04405283

(51) Int. Cl.
*B65G 57/22* (2006.01)

(52) U.S. Cl. ..... 414/792.3; 414/791.6; 414/791.2; 414/792

(58) Field of Classification Search ..... 414/791.2, 414/788.4, 788.6, 789.3, 789.4, 789.8, 790.3, 414/791, 791.4, 791.6, 792, 792.2, 792.3, 414/792.4; 271/218
See application file for complete search history.

(56) References Cited

U.S. PATENT DOCUMENTS 3,362,707 A * 1/1968 Lauren ..... 271/218
3,381,829 A * 5/1968 Turner ..... 414/793.9
3,643,816 A 2/1972 Jacobsen
4,030,621 A * 6/1977 Swanson et al. ..... 414/788.3
4,354,787 A * 10/1982 Gensike et al. ..... 414/791.2
4,854,816 A * 8/1989 Rimmer et al. ..... 414/790.3
4,886,265 A * 12/1989 Wetter ..... 271/279
5,282,716 A * 2/1994 Prim et al. ..... 414/790.3
5,353,576 A * 10/1994 Palamides et al. ..... 53/540
5,387,077 A * 2/1995 Yatsuka et al. ..... 414/791
5,507,615 A * 4/1996 Uno ..... 414/788.3
5,533,860 A * 7/1996 Gammerler ..... 414/789
5,722,514 A * 3/1998 Kiyokawa ..... 187/270
5,827,039 A * 10/1998 Gammerler ..... 414/744.6
5,842,327 A * 12/1998 Schwede ..... 53/540
6,120,239 A * 9/2000 Roskam ..... 414/791.2
6,149,149 A * 11/2000 Gammerler et al. ..... 271/218

FOREIGN PATENT DOCUMENTS

DE 38 08 621 A1 9/1989
DE 4408780 A1 * 9/1995
EP 0 153 983 A 9/1985
EP 0 180 113 A1 5/1986
EP 0 829 441 A1 3/1998
EP 1 167 261 A 1/2002

* cited by examiner

*Primary Examiner*—Gregory W Adams
(74) *Attorney, Agent, or Firm*—Venable LLP; Robert Kinberg; Justine A. Gozzi

(57) ABSTRACT

An apparatus for forming stacks with print products includes a platform on which respective stacks are formed. A lift comprised of two lift parts is arranged on the platform to lift up the print products.

14 Claims, 4 Drawing Sheets

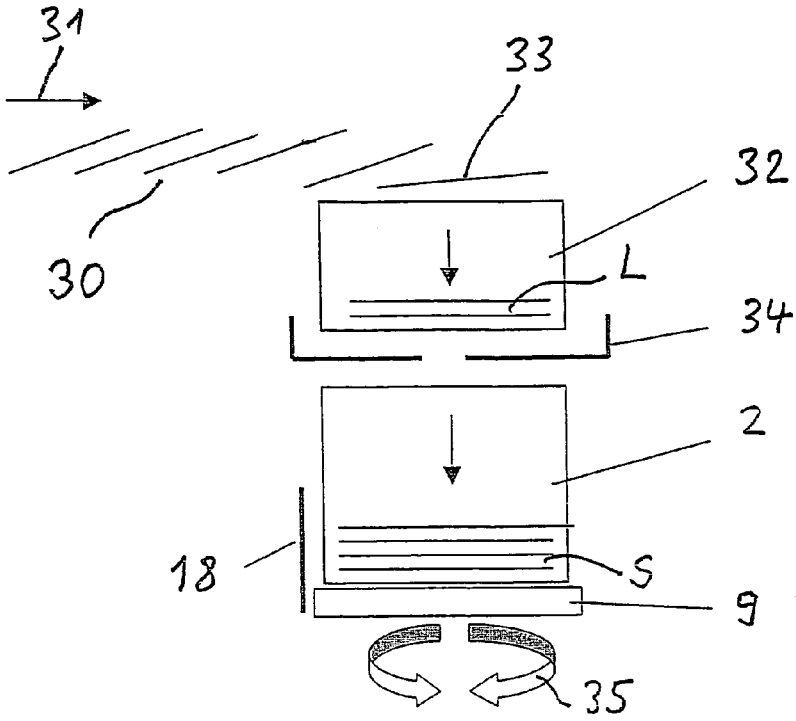
Fig. 3
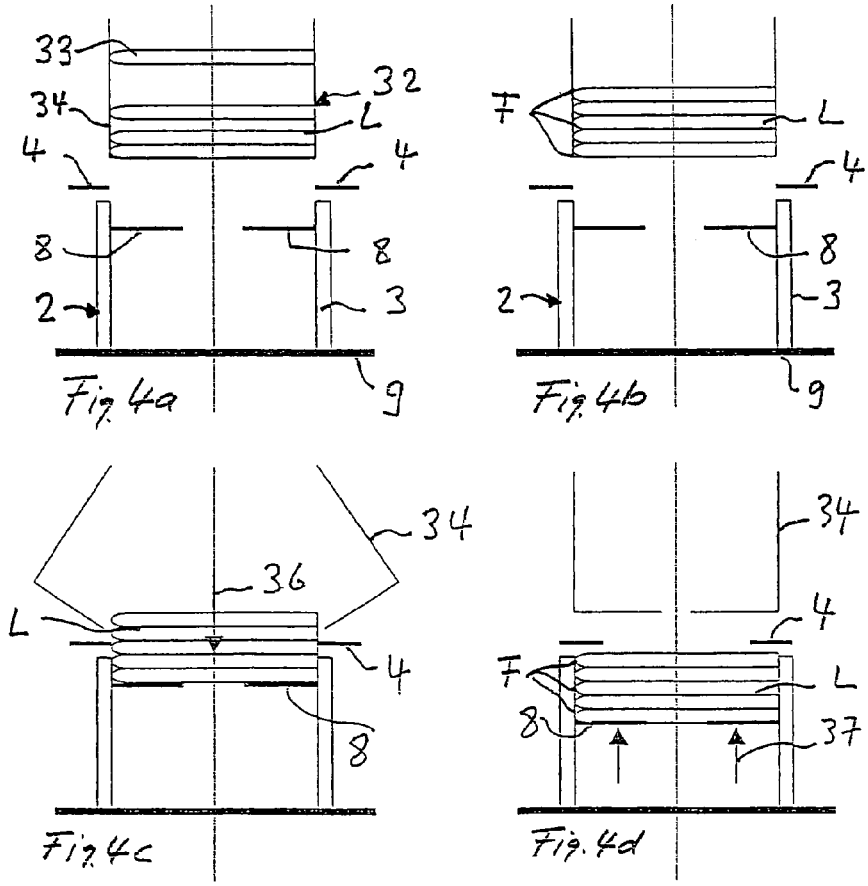

APPARATUS FOR FORMING STACKS WITH PRINT PRODUCTS WITH EJECTION GROOVE AND LIFTING PLATES

CROSS-REFERENCE TO RELATED APPLICATION

This application claims the priority of European Patent Application No. 04405283.5-2314, filed on May 5, 2004, the subject matter of which is incorporated herein by reference. The disclosure of all U.S. and foreign patents and patent applications mentioned below are also incorporated herein by reference.

BACKGROUND OF THE INVENTION

The invention relates to an apparatus for forming stacks with print products, the apparatus comprising a platform on which the stacks are respectively formed and a lift for lifting up the print products.

Apparatuses of the aforementioned type have long been known in the print industry and, in particular, are configured as cross stackers which can be used to create stacks composed of layers that are rotated by 180° relative to each other. The stacks are created from print products such as newspapers, brochures, pamphlets, printed sheets and the like, for example by supplying the print products to the apparatus in an overlapping or shingled flow and with a suitable means of transportation. However, supplying the items individually is conceivable as well. The formed stacks are then removed with a suitable conveying means.

An apparatus of the aforementioned type is disclosed, for example, in European patent document EP 1 167 261 A. The print products supplied to the apparatus are deposited onto a vertically displaceable packing platform. A lift provided with a bottom press plate is disposed in the center of this packing platform. With the aid of the bottom press plate, a formed stack can be lifted up for compressing it and removing it by dropping the stack as a layer. The disadvantage of the known apparatus is that the bottom press plate must be replaced even for small changes in the print product format. It is therefore necessary to make available several such bottom press plates within a specified grid. A further difficulty with the known apparatus is that the folds on the print products are not compressed sufficiently during the compressing operation.

Another apparatus of the type first mentioned above is disclosed in European patent document EP 0 153 983 B, wherein this apparatus also comprises a lift with a base plate. For the compressing operation, compressing elements which can be pivoted are provided above the base plate, wherein a formed stack can be pressed against these elements by lifting up the base plate.

Finally, an apparatus for ejecting stacked printed sheets is disclosed in European patent document EP 0 829 441 A.

SUMMARY OF THE INVENTION

It is an object of the present invention to create an apparatus of the aforementioned type which avoids the above-mentioned disadvantages.

The above and other objects are accomplished according to the invention by the provision of an apparatus for forming stacks with print products, comprising: a platform on which respective stacks are formed; and a lift arranged on the platform to lift up the print products, the lift comprising two lift parts to jointly lift up the stack of printed products.

The two-part design, using two separate lift parts, which may be in the form of lifting plates, represents an essential advantage for the further processing of the compressed stack. Two lift parts are therefore used in place of a single, centrally positioned base plate, wherein these two lift parts jointly lift up the stack of printed products. The lifting operation can be used for compressing the stack or picking up a new layer.

The apparatus according to the invention has the additional advantage that the center of the rotatable platform can be reserved for an ejection groove, wherein this ejection groove can be arranged between the two lift parts. As a result, an ejection from the bottom is possible which permits a considerable reduction in the cycle time.

According to a further modification of the invention, the lift is divided into two lift parts which are respectively provided with a separate lifting plate. The distance between the lifting plate and the format outside edge can thus always be kept constant. As a result, the lifting plates must be replaced only for larger format changes.

In one exemplary embodiment, the lift is integrated in a compartment of the rotatable platform.

According to another exemplary embodiment of the invention, the platform is provided with a horizontally extending ejection groove. As previously mentioned, an ejection from below is possible in this way and results in considerably shorter cycle times.

According to yet another exemplary embodiment, a driver, or pusher, is provided that can be displaced vertically and horizontally inside the ejection groove. According to a further modification, the driver is rod-shaped and is therefore particularly flexible for adapting it to the stack and especially to the stack height.

Additional advantageous features follow from the dependent patent claims, the following description, as well as the drawing.

BRIEF DESCRIPTION OF THE DRAWINGS

In the following, an exemplary embodiment of the invention is explained with the aid of the drawing, which shows in:

FIG. 3 is a schematic configuration of an apparatus according to the invention;

FIGS. 4*a*-4*e* are schematics showing individual steps for forming and compressing a stack.

DETAILED DESCRIPTION OF THE INVENTION

Referring initially to FIG. 3, there is shown a layer L, which is understood herein to consist of a group of print products placed one above the other and aligned the same way. FIG. 3 shows such a layer L wherein the layer L is formed with print products 33 that are conveyed in an overlapping flow 30 in the direction of arrow 31. A transporting device that is not shown herein is used for transporting the print products in a manner known per se. A stack S usually comprises several layers L which are generally deposited so as to be rotated by 180° relative to each other. The technique of forming stacks S with layers L which are displaced relative to each other by 180° is referred to as the so-called cross-stacking.

Figure 1:
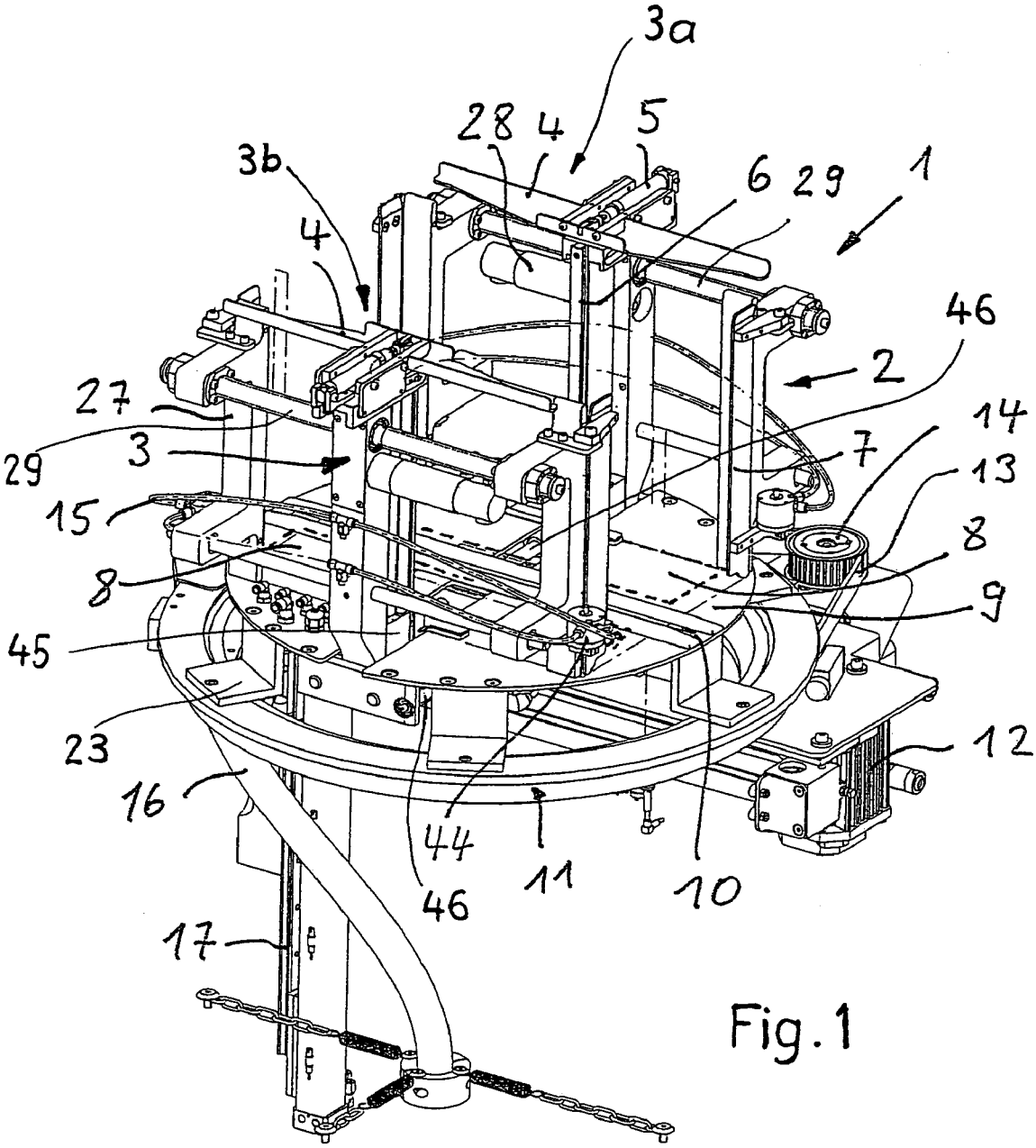
FIG. 1 shows a three-dimensional view of an apparatus according to the invention.

Referring now to FIG. 1, there is shown an apparatus comprising a rotatable platform compartment 2 with four compartment flaps 7 which can pivot around a vertical axis, e.g. pneumatically, for ejecting a formed stack S. Pneumatic lines 15 as well as respectively one pivoting drive 44 are provided for this. The rotatable platform compartment 2 is positioned on a rotatable platform 9 which is attached by angled supports 23 or other suitable fastening means to a rotatable ring 11. This rotatable ring 11 can be operated by a motor 12 which is connected by a toothed gear 14 and a toothed belt 13 to the rotatable ring 11. An ejection groove 10 which accommodates a driver 18 of an ejection device 17 (see also FIG. 2) extends diametrically through the rotatable platform 9. A flexible guide channel 16 is provided for the pneumatic lines 15 leading to the rotatable platform 9. Of course, other types of lines can also be run through this channel 16.

A lift 3 is integrated into the rotatable platform compartment 2. This lift 3 consists of two layer lift parts 3*a* and 3*b* which are positioned substantially mirror symmetrical to each other on opposite sides of the ejection groove 10. The lift parts 3*a* and 3*b* are essentially identical in design and operate for the most part synchronously. Each lift part 3*a* and 3*b* is provided with a lifting plate 8, shown with dashed lines in FIG. 1. For the apparatus shown herein, these lifting plates 8 rest against the rotatable platform 9. The lifting plates 8 are respectively positioned on a lift guide 6 and can be displaced vertically thereon. The lifting plates 8 are preferably moved along the lift guide 6 by pneumatic cylinders 45, wherein both lifting plates 8 operate independent of each other. However, both lifting plates 8 are preferably moved synchronously.

By activating the pneumatic cylinders 45, the lifting plates 8 can thus be raised to the position shown in FIG. 1 and can also be moved back to the starting position. The lifting plates 8 can be raised maximally to the position of pressing flaps 4, or the lifting operation is purposely reduced to a specified level for retrieving falling layers. Servomotors could also be used for generating the drive force in place of the pneumatic cylinders 45. The two lifting plates 8 are arranged at a distance to each other, so that a passage is created in-between, wherein the above-mentioned ejection groove 10 is arranged freely between these lifting plates 8.

The two lift parts 3*a* and 3*b* are each provided with a separate pressing flap 4 which can be moved horizontally by means of a pneumatic cylinder 5. The pressing flaps 4, shown in FIG. 1, are each depicted in the position where they are pulled back. In this position, the layers L can be inserted freely from above into the rotatable platform compartment 2. In a different, pushed-forward position, these pressing flaps 4 project at least partially into the rotatable platform compartment 2. Known pneumatic cylinders 5 are preferably used for the flap movement, wherein it is also conceivable to use different drive means, e.g. a servomotor.

Format adjustments on the rotatable platform compartment 2 in the direction of the ejection groove may be effected by motors 28 which transmit a driving movement via gears, not described in further detail herein, and shafts 29 that are designed as spindles to the compartment flaps 7.

Format adjustments of the rotatable platform compartment 2, at a right angle to the ejection groove 10, are also effected with motors which are not described in further detail herein, wherein these motors transmit the driving movement via shafts 46 to the individual units, consisting of lift parts 3*a*,3*b* and the compartment flaps 7.

The rotatable platform compartment 2 is supplied with layers L by a layer tray 32 and forks 34, as shown in FIG. 3. In FIG. 3, a layer L is positioned inside a layer tray 32. A fork 34 is closed herein and keeps the layer L in the position shown. The fork 34 can be opened up, so that the layer L drops from above into the rotatable platform compartment 2. To reduce the drop distance, the lift plates 8 with a pre-formed partial stack S are preferably raised up. Prior to accepting a layer L, the partially formed stack S is turned 180° by rotating the platform 9, as shown with arrow 35.

Figure 2:
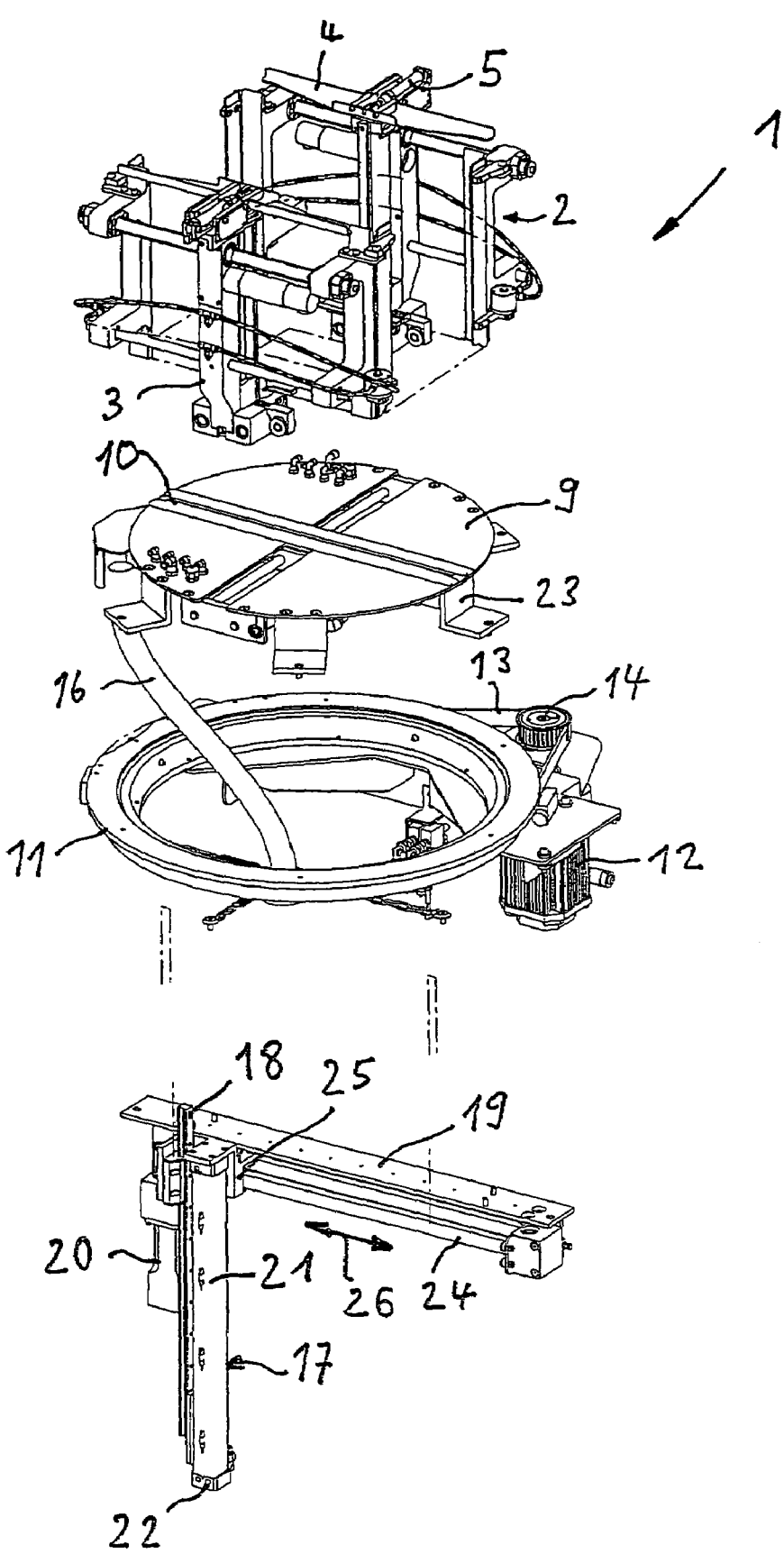
FIG. 2 shows an exploded view of the apparatus according to FIG. 1, with the parts separated out.

The previously mentioned ejection device 17 is provided for ejecting a completed stack S from the rotatable platform compartment 2, wherein this ejection device is provided with a support 19 as shown in FIG. 2. This support is attached on the underside to the rotatable platform 9 and extends parallel to the ejection groove 10. Guide rods 24 or similar guiding means are provided on the underside of support 19. A slide 25 is positioned on these guide rods and can be displaced horizontally in the directions of double arrow 26. A pneumatic cylinder 21 or a different suitable drive means, e.g. a servomotor, is mounted on the slide 25. The rod-shaped driver 18 is displaced vertically pneumatic cylinder 21. An additional drive 20, e.g. a servomotor, is provided for the horizontal movement of the slide 25, wherein the horizontal movement can also be effected pneumatically. A suitable connector 22 is arranged at the lower end of the pneumatic cylinder 21 for connecting the pneumatic cylinder 21 to the pneumatic line which is not shown herein. The driver 18 thus can be moved simultaneously in a horizontal direction, as shown with double arrow 26, and also in a vertical direction, wherein a control unit that is not shown herein is naturally provided for controlling the drives.

The mode of operation for the apparatus 1 according to the invention is explained in the following with the aid of FIGS. 4*a* to 4*e*.

FIG. 4*a* shows a beginning state in which the rotatable platform compartment 2 is still empty. A fork 34 of the layer tray 32 is closed. Newly fed-in printed products 33 are kept inside this layer tray 32 and eventually form a layer L. The two pressing flaps 4 are in the retracted position, so that the rotatable platform compartment 2 is open on the top. The two lifting plates 8 are in a raised position. The printed products 33 in the layer L are each provided with a fold F. These folds F are stacked one above the other and are thus positioned on the same side of the layer tray 32.

FIG. 4*b* shows a completed layer L, formed inside the layer tray 32.

With a completely formed layer as shown in FIG. 4*b*, the fork 34 is opened as shown in FIG. 4*c*. The layer L consequently drops vertically downward in the direction of arrow 36 and onto the raised lifting plates 8, wherein the drop distance is comparatively short because the lifting plates 8 are raised.

The lifting plates 8 are then moved downward, wherein the layer L is guided and aligned by means of the compartment flaps 7 of the rotatable platform compartment 2. The pressing flaps 4 are moved to the position shown in FIG. 4*d* at the same time as the fork 34 is closed. In this position, the pressing flaps 4 project at least partially into the rotatable platform compartment 2. The layer L is then raised in the direction of arrows 37 and is compressed against the moved-in pressing flaps 4. The two lifting plates 8 in this case are raised synchronously by correspondingly activating the two lift parts 3*a* and 3*b*. In FIG. 4*d*, the folds F are completely supported on the left lifting plate 8, meaning these folds F can be compressed completely and effectively. The lifting plate 8 thus extends also into the region of fold F.

Figure 4E:
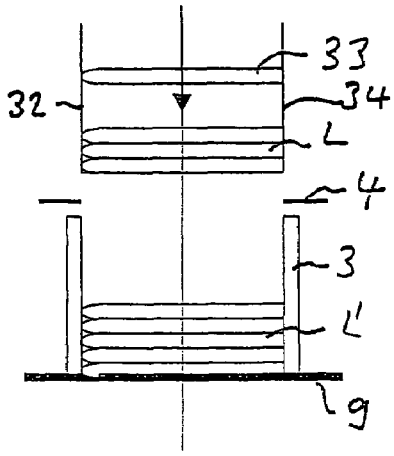

Once the layer L is compressed, the compressed layer L' is moved downward, as shown in FIG. 4*e* while the pressing flaps 4 are simultaneously moved to the pulled-back position. The fork 34 remains closed, so that a different layer L is formed at the same time in the layer tray 32. The layer L' is turned by rotating the platform 9 by 180°. Once a new layer L is formed in the layer tray 32, the above-explained action is repeated, wherein two cross-stacked layers L are compressed in this case. This action can be repeated several times, finally resulting in a stack S that consists of several cross-stacked layers L. The lifting distance of the lifting plates 8 for the compressing operation is correspondingly adapted to the height of the formed stack S.

Figure 5A:
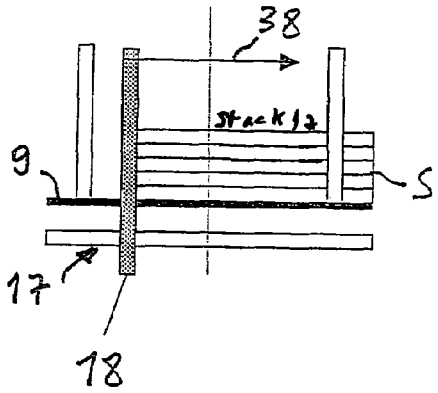
FIGS. 5*a*-5*b* are schematics showing the ejection of a formed and compressed stack.
Figure 5B:
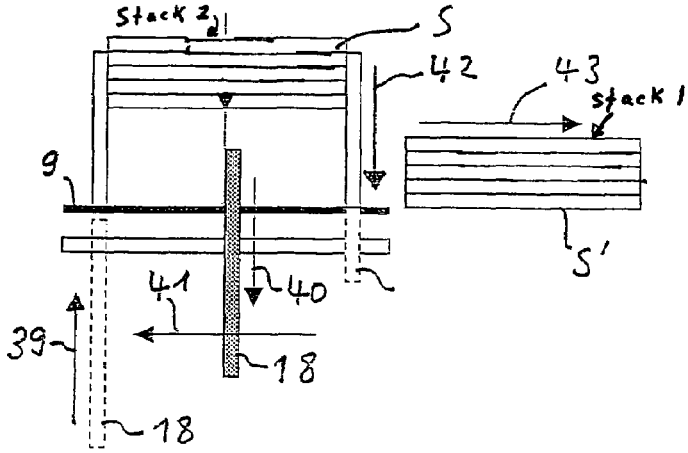

FIGS. 5*a* and 5*b* schematically show the ejection of a formed stack S. As previously mentioned, this stack S can comprise several cross-stacked layers L. While the stack S is formed, the driver 18 is positioned completely below the platform 9, as indicated in FIG. 5*b* with dashed lines. Following the conclusion of the last rotation of platform 9 by 180° and prior to ejecting the stack S, the driver 18 is raised format-dependent directly to the left of the formed stack S in the direction 39. The level to which the driver can be raised in this case depends on the height of the stack S. Following the stack completion, the driver 18 is moved in the direction 38 for ejecting the stack S from the rotatable platform compartment 2. The raised driver 18 in this case rests against the stack S and pushes the stack from left to right, as shown in FIG. 5*a*. As soon as the stack S has left the area of the rotatable platform compartment 2, the driver 18 is moved back simultaneously in the directions 40 and 41 to the starting position. Of course, the ejection operation can also be carried out in the opposite direction. In the process, the movement of driver 18 for the ejection in the direction 38 can be changed on the basis of the available cycle time, wherein especially the acceleration and speed can be changed. Before the driver 18 is moved back in the direction of arrow 41, a newly formed stack S and/or a new layer L can simultaneously be moved downward in the direction of arrow 42 and onto the rotatable platform 9.

FIG. 5*b* shows an ejected stack S' which is moved in the direction of arrow 43 toward a transporting means that is not shown herein. The ejected stack S' is thus conveyed on immediately for further processing, for example by packaging and addressing it for the shipping. Thus, it is not necessary to wait until the driver 18 has returned to the rest position before depositing a newly formed stack S and/or a new layer L. The downward movement of the driver 18 in the direction of arrow 40, and in a horizontal direction in the direction of arrow 41 can occur simultaneously when depositing the stack S and/or the new layer L in the direction of arrow 42, thereby resulting in a particularly short cycle time.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus for forming stacks with print products, comprising:

a rotatable ring;

a platform on which respective stacks of print products are formed, the platform being positioned inside the rotatable ring and being rotatable, the platform including a horizontally extending ejection groove that extends continuously in a vertical direction through the platform;

a lift arranged on the platform so that the lift and the platform comprise an integral unit, the lift configured to move at least one of the print products or the formed stacks of print products, the lift comprising two lifting plates disposed substantially symmetrically opposing one another to define an unobstructed passage wherein the lifting plates are embodied such that they are vertically displaceable relative to the platform and the ejection groove is disposed in the unobstructed passage between the two lifting plates; and an ejection device including a driver moveable from below the platform through the ejection groove into the unobstructed passage between the lifting plates.

2. The apparatus according to claim 1, wherein the driver is moveable in a vertical direction and in a horizontal direction.

3. The apparatus according to claim 2, wherein the driver is moveable up and down vertically in dependence on a stack height.

4. The apparatus according to claim 1, wherein the driver is movable vertically along a back end of the stack with respect to an ejection direction and format size of a print product.

5. The apparatus according to claim 1, wherein ejection movement of the driver is controllable and changeable.

6. The apparatus according to claim 1 wherein the driver is rod-shaped.

7. The apparatus according to claim 1, wherein the lift further includes lift guides arranged at a distance to each other, wherein each lifting plate is guided by the respective lift guide for vertical displacement.

8. The apparatus according to claim 1, wherein the ejection device is positioned independent of the platform.

9. The apparatus according to claim 1, wherein the lift is connected to the platform.

10. The apparatus according to claim 1, further including at least one pressing flap arranged so that a lifting movement of the lift compresses at least one layer against the pressing flap, wherein the layer comprises at least one of the print products or respective stacks of print products.

11. The apparatus according to claim 10, wherein the lift further includes at least one lifting part, wherein the lifting part includes one of the lift plates and at least one pressing flap positioned on the at least one lifting part.

12. The apparatus according to claim 11, wherein the at least one pressing flap comprises two pressing flaps separately positioned on each respective lifting part.

13. The apparatus according to claim 1, wherein each lifting plate is independently operable from one another.

14. The apparatus according to claim 13, wherein the lifting plates are moved synchronously with one another.

* * * * *